US012564239B1

(12) United States Patent
Martinez

(10) Patent No.: US 12,564,239 B1
(45) Date of Patent: Mar. 3, 2026

(54) WEARABLE AIR FLOW SAFETY SYSTEM

(71) Applicant: Juan Antonio Sandoval Martinez, Huntington Beach, CA (US)

(72) Inventor: Juan Antonio Sandoval Martinez, Huntington Beach, CA (US)

( * ) Notice: Subject to any disclaimer, the term of this patent is extended or adjusted under 35 U.S.C. 154(b) by 0 days.

(21) Appl. No.: 18/046,733

(22) Filed: Oct. 14, 2022

Related U.S. Application Data

(60) Provisional application No. 63/262,613, filed on Oct. 15, 2021.

(51) Int. Cl.
*A42B 3/28* (2006.01)
*A62B 7/10* (2006.01)

(52) U.S. Cl.
CPC ..... *A42B 3/286* (2013.01)

(58) Field of Classification Search
CPC ..... A42B 3/286
See application file for complete search history.

(56) References Cited

U.S. PATENT DOCUMENTS 2,029,566 A * 2/1936 Herzer ..... A62B 18/04 128/201.25
2,663,870 A * 12/1953 Feldman ..... A42B 1/247 2/10
3,168,748 A * 2/1965 Limberg ..... A42C 5/04 416/63
3,353,191 A * 11/1967 Dahly ..... A42C 5/04 62/235.1
3,535,707 A * 10/1970 Greenlee ..... A61F 9/068 128/200.27
3,735,423 A * 5/1973 Droz ..... A42C 5/04 D2/866
3,881,198 A * 5/1975 Waters ..... A42C 5/04 2/906
3,906,548 A * 9/1975 Kallis ..... A42B 3/14 2/416
3,963,021 A * 6/1976 Bancroft ..... A62B 18/045 128/201.25
4,238,857 A * 12/1980 Waters ..... A42B 1/008 2/906
4,280,491 A * 7/1981 Berg ..... A42B 3/288 55/DIG. 35
D264,016 S * 4/1982 Fournier ..... D2/866
4,350,507 A * 9/1982 Greenough ..... G01N 1/2205 55/482
4,462,399 A * 7/1984 Braun ..... A62B 18/045 55/DIG. 35
4,546,496 A * 10/1985 Lewis ..... A42C 5/04 2/436
4,672,968 A * 6/1987 Lenox ..... A61B 90/00 607/109
4,680,815 A * 7/1987 Hirsch ..... A42C 5/04 2/171.3
4,703,879 A * 11/1987 Kastendieck ..... A61F 9/027 359/477
4,730,612 A * 3/1988 Dampney ..... A62B 18/045 128/201.24

(Continued)

*Primary Examiner* — Robert H Muromoto, Jr.
(74) *Attorney, Agent, or Firm* — Knobbe, Martens, Olson & Bear, LLP

(57) ABSTRACT

A wearable air flow safety system can include one or more fans mounted on an article of headwear to reduce exposure to noxious vapors and particulate matter through directed air flow across the user's face.

15 Claims, 24 Drawing Sheets

(56) References Cited

U.S. PATENT DOCUMENTS 4,744,106 A * 5/1988 Wang ..... A42B 3/286 D29/103
4,893,356 A * 1/1990 Waters ..... A42B 1/008 2/909
4,987,608 A * 1/1991 Cobb ..... A42B 3/04 2/6.2
4,996,981 A * 3/1991 Elenewski ..... H01M 50/569 128/201.15
5,009,225 A * 4/1991 Vrabel ..... A62B 18/006 128/202.19
5,046,329 A * 9/1991 Travis, III ..... F25D 3/08 62/406
5,054,480 A * 10/1991 Bare ..... A62B 18/045 128/206.28
5,085,231 A * 2/1992 Johnson ..... A42C 5/04 131/331
5,113,853 A * 5/1992 Dickey ..... A62B 18/045 128/201.24
5,193,347 A * 3/1993 Apisdorf ..... G05D 23/1919 62/259.3
5,283,914 A * 2/1994 James ..... A42B 3/16 128/201.24
5,425,620 A * 6/1995 Stroud ..... A42C 5/04 403/360
5,468,124 A * 11/1995 Chen ..... F04D 25/08 416/246
5,471,678 A * 12/1995 Dor ..... G02B 23/125 2/6.7
5,533,500 A * 7/1996 Her-Mou ..... A42B 3/288 128/205.12
5,561,862 A * 10/1996 Flores, Sr. ..... A42B 3/286 2/422
5,592,936 A * 1/1997 Thomas, Jr. ..... A41D 13/11 128/201.24
5,655,374 A * 8/1997 Santilli ..... A41D 13/1218 2/905
5,711,033 A * 1/1998 Green ..... F04D 17/16 2/424
5,760,953 A * 6/1998 Task ..... G02B 23/125 359/827
5,878,742 A * 3/1999 Figueredo ..... A62B 18/003 128/201.24
6,092,239 A * 7/2000 Pogrebitsky ..... A42B 1/0192 2/209.3
6,370,695 B2 * 4/2002 Paris ..... A41D 13/11 2/202
6,382,208 B2 * 5/2002 Reedy ..... G05D 27/00 128/205.25
6,393,617 B1 * 5/2002 Paris ..... A62B 17/04 2/171.3
6,464,468 B2 * 10/2002 Colburn ..... F04D 25/084 416/247 R
6,481,019 B2 * 11/2002 Diaz ..... A41D 13/11 128/201.19
6,513,168 B2 * 2/2003 Paris ..... A62B 18/045 128/201.24
6,622,311 B2 * 9/2003 Diaz ..... A41D 13/1153 2/205
6,711,748 B2 * 3/2004 Paris ..... A41D 13/1209 2/422
6,918,141 B2 * 7/2005 Green ..... A42B 3/10 128/201.25
6,931,668 B2 * 8/2005 Dobbie ..... A42B 1/046 2/6.1
6,973,677 B2 * 12/2005 Diaz ..... A41D 13/1153 128/201.19
6,990,691 B2 * 1/2006 Klotz ..... A42B 3/286 2/901
7,178,207 B2 * 2/2007 Wong ..... A41F 1/002 24/303
7,200,873 B2 * 4/2007 Klotz ..... A42B 3/14 128/201.24
7,752,682 B2 * 7/2010 VanDerWoude ..... A41D 13/11 2/410
7,810,492 B2 * 10/2010 Church ..... F04D 27/004 128/201.24
7,878,195 B2 * 2/2011 Alvey ..... A62B 18/08 128/201.24
7,937,779 B2 * 5/2011 Klotz ..... A42B 3/286 2/419
8,234,722 B2 * 8/2012 VanDerWoude ..... A42B 3/286 2/410
9,486,026 B1 * 11/2016 Cook, Sr. ..... F04D 25/084
9,631,804 B1 * 4/2017 Glenn ..... F21V 33/00
9,756,888 B2 * 9/2017 Ku ..... A42B 1/008
10,578,119 B2 * 3/2020 Lee ..... A41D 20/005
10,881,160 B2 * 1/2021 Kaye ..... F21V 21/0965
11,071,881 B1 * 7/2021 Cullen ..... A41D 13/0025
11,131,310 B1 * 9/2021 Emery ..... H02J 50/10
11,241,060 B2 * 2/2022 Wong ..... A42B 3/281
11,478,325 B2 * 10/2022 Learn ..... A41D 20/005
11,779,075 B2 * 10/2023 Frejd ..... A42B 3/042 2/15
11,872,938 B2 * 1/2024 Biesinger ..... B60R 11/00
11,920,602 B2 * 3/2024 Li ..... F04D 25/084
2001/0032348 A1 * 10/2001 Diaz ..... A41D 13/1153 2/424
2003/0182711 A1 * 10/2003 Klotz ..... A41D 13/0025 2/171.3
2005/0060925 A1 * 3/2005 Kaneko ..... A44C 3/001 40/661.04
2005/0106018 A1 * 5/2005 Stengel ..... F04D 29/601 416/63
2005/0116042 A1 * 6/2005 Willkens ..... A45F 5/02 235/472.01
2007/0044800 A1 * 3/2007 Church ..... F04D 27/004 128/205.29
2008/0222777 A1 * 9/2008 Schneider ..... A42B 1/008 2/209.13
2009/0031475 A1 * 2/2009 Ochoa ..... A42B 1/244 2/209.13
2009/0276940 A1 * 11/2009 Sallee ..... A42B 3/24 2/435
2010/0000007 A1 * 1/2010 Wood ..... A42B 1/008 2/195.1
2010/0005633 A1 * 1/2010 Nolet ..... H01F 7/0221 24/303
2010/0017941 A1 * 1/2010 Taylor ..... A42B 1/008 2/209.13
2010/0175556 A1 * 7/2010 Kummer ..... B01D 46/52 55/471
2010/0246864 A1 * 9/2010 Hildebrandt ..... H04R 3/04 381/310
2011/0280726 A1 * 11/2011 Ochoa ..... F04D 25/0673 416/63
2013/0094980 A1 * 4/2013 Chan ..... F04D 25/084 417/423.1
2013/0326793 A1 * 12/2013 Bingley ..... G09F 21/02 2/209
2014/0090410 A1 * 4/2014 Decker ..... F04D 25/0673 62/259.3
2015/0143612 A1 * 5/2015 Noble ..... A42B 1/008 2/171.3
2015/0296917 A1 * 10/2015 Perusse ..... A42B 3/286 2/15
2016/0100647 A1 * 4/2016 Raiffeisen ..... F04D 25/084 2/171.3
2016/0281742 A1 * 9/2016 Rivera ..... F04D 25/0673
2017/0112203 A1 * 4/2017 Kaye ..... G02B 27/144
2018/0084848 A1 * 3/2018 Pavalarajan ..... H03M 5/145
2018/0266714 A1 * 9/2018 Perrelle ..... F04D 25/084
2018/0325199 A1 * 11/2018 Otey ..... F04D 29/626
2020/0033920 A1 * 1/2020 Nielsen ..... G05D 23/1917
2020/0332809 A1 * 10/2020 Buxton ..... F04D 29/601
2022/0148557 A1 * 5/2022 Reid ..... A62B 18/003

(56) References Cited

U.S. PATENT DOCUMENTS

| | | | | |
|---|---|---|---|---|
| 2022/0176168 | A1* | 6/2022 | Adams | H04R 1/083 |
| 2023/0120339 | A1* | 4/2023 | Kim | F04D 29/601 415/213.1 |

* cited by examiner

WEARABLE AIR FLOW SAFETY SYSTEM

INCORPORATION BY REFERENCE TO ANY PRIORITY APPLICATIONS

This application claims the priority benefit under at least 35 U.S.C. § 119 of U.S. Patent Application No. 63/262,613, filed Oct. 15, 2021, entirety of which is hereby incorporated by reference herein.

Any and all applications for which a foreign or domestic priority claim is identified in the Application Data Sheet as filed with the present application are hereby incorporated by reference under 37 CFR 1.57.

FIELD

The present disclosure relates to the fields of wearable ventilation devices and portable safety equipment, such as headwear comprising a fan.

BACKGROUND

Humans, like most living things, need oxygen to survive. Oxygen aids in growth, reproduction, and metabolizing food into energy. Humans get the oxygen they need by breathing air. A fan can be used to generate a flow of air.

SUMMARY OF CERTAIN ASPECTS

A flow of air directly on or over a person's nose can make breathing easier. In certain situations, a flow of air over or around the person's head, face, or nose can act as a barrier to or shield against dust, odors, or otherwise. A flow of air can convey unwanted heat or waste (e.g., exhaled carbon dioxide). A flow of air directly to the person's face may be particularly beneficial during exertive activities (e.g., sports, physical labor, etc.) and/or activities that involve particulate matter or fumes (e.g., sanding, dusting, painting, lacquering, etc.). Because such activities may require bodily movement or the use of hands, it can be further beneficial for the airflow to be portable and to not depend on use of the hands for operation. A flow of air directly to the person's face can also be beneficial during non-exertive activities, such as sleeping or sitting, as the flow of air can provide and/or be perceived as making breathing easier.

The present technology relates to a wearable air flow safety system, such as a fan mounted on an article of headwear, that addresses one or more of the aforementioned aspects, or other aspects. The system can comprise one or more air movement devices, such as a fan, configured to reduce exposure to noxious vapors and particulate matter through air flow directed across the user's face. The one or more fans can blow air directly onto the user's face, such as on and/or over the user's nose. The airflow can be downwardly directed. In some embodiments, the headwear comprises a hat. The hat can have a bill (also called a visor), which may support the fan. The hat can be adjustable, such as with a strap.

In some embodiments, the one or more fans are mounted to a headband. The headband may be an elastic, cloth, leather, or a synthetic material. The headband straps may be adjustable in length. In some embodiments, the headband has two straps, one encircling the head horizontally and one strap oriented vertically on the head. In other embodiments, the headband may have one horizontal strap and no vertical strap. In other embodiments, the headband may have more than one vertical strap and more than one horizontal strap.

In other embodiments, the headband may have more than one horizontal strap and no vertical strap.

In some embodiments, the electrical wiring connecting to the power source is connected to the one or more fans across the vertical strap. In other embodiments, the electrical wiring connecting to the power source may be connected to the fan across the one or more horizontal straps or the one or more horizontal straps and the one or more vertical straps.

In some embodiments, the one or more fans attached to the front of the headwear oriented so that air flow is directed downwards.

In some embodiments, the power source for the one or more fans is an external battery. In other embodiments, the power source may be an internal battery. In other embodiments, the power source may be connected to a solar panel.

In some embodiments, the one or more fans are located at the center of the headwear where the horizontal and vertical straps meet. In some embodiments, one or more fans may be attached to the center of the headband where the horizontal and vertical straps meet.

In some embodiments, the one or more fans are adjustably mounted to a plastic mounting bracket attached to the headwear. In other embodiments, the mounting bracket may be wood, metal, or a synthetic material.

In some embodiments, the one or more fans can rotate. In other embodiments, the one or more fans may rotate vertically with respect to the headwear. In some embodiments, the range of rotation is from 0 degrees to 90 degrees. In some embodiments, the range of rotation is from 0 degrees to 45 degrees. In some embodiments, the range of rotation is from 0 degrees to 30 degrees. In some embodiments, the range of rotation is from 0 degrees to 15 degrees. In some embodiments, the range of rotation is from 0 degrees to 10 degrees.

In some embodiments, the speed of the one or more fans may be adjustable. In some embodiments, the speed of the one or more fans may range from 500 rpm to 5000 rpm.

In some embodiments, the air intake section of the one or more fans may have a removable filter attached. In some embodiments, the air intake section of the one or more fans may be oriented on the sides perpendicular to the exit air flow of the one or more fans.

In some embodiments, the power switch to activate the one or more fans is located on the electrical wiring between the power source and the headwear. In other embodiments, the power switch may be located on the headwear, on the one or more fans, or on the power source.

In some embodiments, the one or more fans attached to the headwear may be attached to a filter comprising a filter body, one or more additional fans, tubing, filter materials, and an additional power source.

In some embodiments, the filter body may contain one or more filter materials.

In some embodiments, the headwear may additionally comprise a visor.

In some embodiments, the headwear may additionally comprise eye protection.

In some embodiments, the eye protection is mounted onto a visor.

In some embodiments, the eye protection is mounted onto the visor by one or more adjustable rails.

In some embodiments, the headwear additionally comprises one or more lights.

In some embodiments, the one or more lights are mounted onto a visor.

In some embodiments, the one or more lights are turned on through a power switch other than the switch used to turn on the one or more fans.

In some embodiments, the power switch used to turn on the one or more lights is a capacitive switch In some embodiments, the one or more lights are powered by a power source other than the power source used to power the one or more fans In some embodiments, the headwear of may additionally comprise one or more fans located over the user's ears.

In some embodiments, the one or more fans additionally located over the user's ears vents are facing in opposing directions.

In some embodiments, the exit air flow of the one or more fans additionally located over the user's ears is oriented to blow air towards the front and back of the user's head.

In some embodiments, the one or more fans additionally located over the user's ears have adjustable fan speeds.

In some embodiments, the one or more fans additionally located over the user's ears have adjustable fan speeds between approximately 500 to 5,000 rotations per minute.

In some embodiments, the one or more fans additionally located over the user's ears are powered by a source other than the power source used to power the one or more fans.

In some embodiments, the one or more fans additionally located over the user's ears are turned on by a switch other than the switch used to turn on the one or more fans.

In some embodiments, the switch used to turn on the one or more fans additionally located over the user's ears is a capacitive switch.

In some embodiments, a filter is removably attached to the air intake sections of the one or more fans additionally located over the user's ears.

In some embodiments, the air intake sections of the one or more fans additionally located over the user's ears are located perpendicular to the exit air flow of the fan.

In some embodiments, the one or more fans attached to the filter body may be removably attached.

In some embodiments, an air flow sensor may be attached to the one or more fans attached to the filter body.

In some embodiments, the one or more fans attached to the filter body may have adjustable fan speeds.

In some embodiments, the support base, power source, and power switch are each removably attached to the headwear by one or more magnets.

In some embodiments, the mounting bracket, power source, and power switch are each removably attached to the headwear by one or more magnets.

In some embodiments, the one or more fans, the power source, and the power switch are each removably connected to the headwear by one or more magnets.

Certain embodiments include a first fan (as discussed above) and a second fan. The second fan can act as a pre-fan for the first fan. The second fan can be separate from the first fan. For example, the first fan can be located on the user's head and the second fan can be located at a remote location, such as on the user's back or waist. The second fan can be coupled to a filter canister, which can contain a filter material. The second fan can be coupled to the top, bottom, or side of the filter canister, depending on the embodiment. The second fan can be removable from the filter canister to allow for cleaning of the filter material and/or the canister. A flexible tube or duct can connect the second fan to the first fan. The first and second fans can have the same or different power sources (e.g., batteries). The first fan and/or second fan can be constant or adjustable speed. Some embodiments have a sensor to detect a pressure drop as the filter gets dirty. The pressure drop can be used to drive the fan, such as with a feedback loop.

DETAILED DESCRIPTION OF CERTAIN EMBODIMENTS

Disclosed herein are various embodiments of headwear that comprise a ventilation device, such as a hat or headband with one or more fans oriented such that airflow is directed over the user's face. The orientation of the air flowing from the one or more fans can be directed at an angle slightly away from the user's face, dispersing noxious vapors and particulate matter in the air around their nose and mouth. The air flow across the user's face is believed to reduce the user's airborne intake of microbes such as viruses and bacteria, increase physical performance (e.g., during sports), enhance restfulness or sleeping, and/or promote comfort.

Figure 1A:
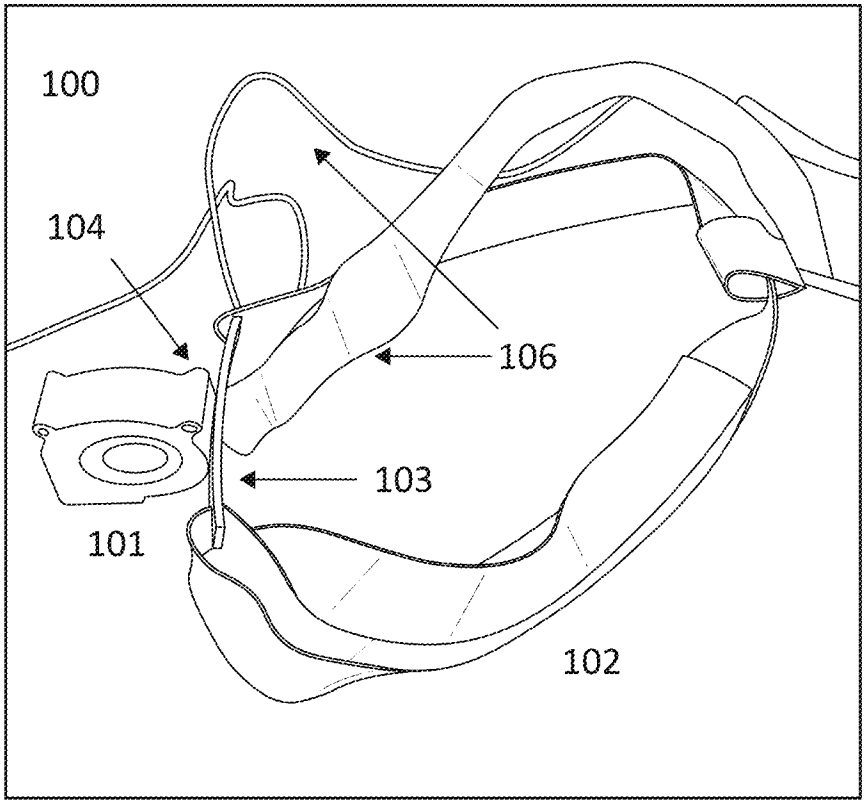
FIG. 1A shows an embodiment of a headwear mounted fan as seen from the side.
Figure 1B:
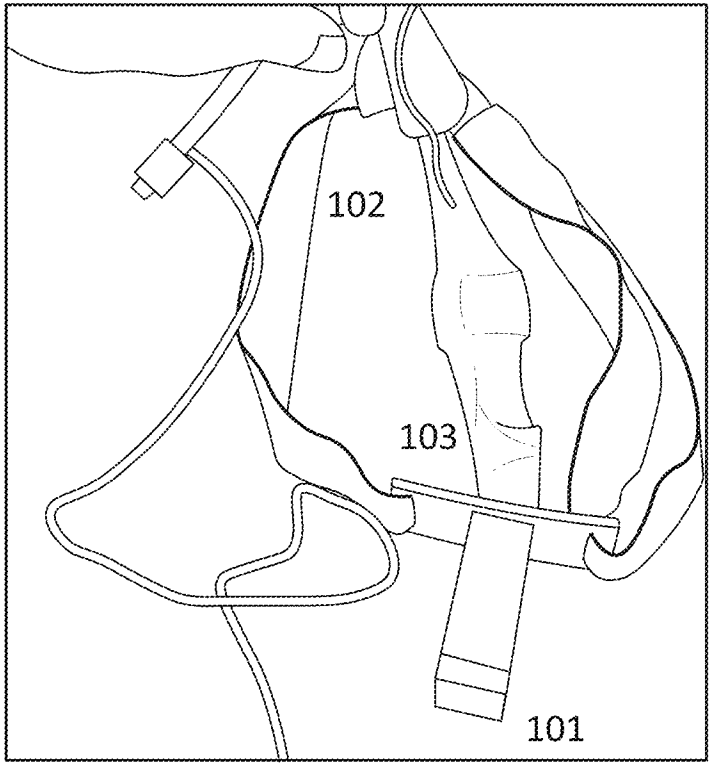
FIG. 1B shows the fan of FIG. 1A as seen from the top.
Figure 1C:
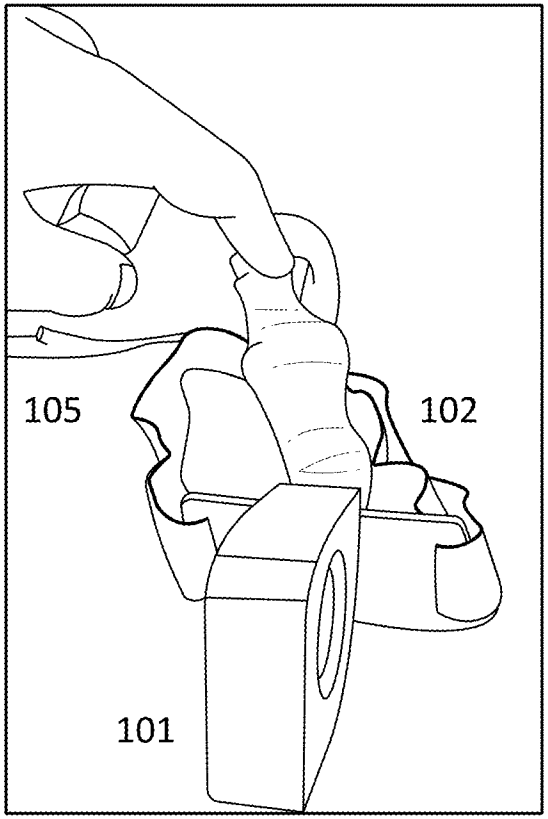
FIG. 1C shows the fan of FIG. 1A as seen from the front.

FIGS. 1A, 1B, and 1C show an embodiment of a headband mounted fan from the side, top, and front, respectively. The headband mounted fan device 100 is comprised of a fan 101, headband with straps 102, mounting bracket 103 with a hinge 104, power switch 105, and a power source 201. Electrical wiring 106 connects the one or more fans to the power source 201 and power switch 105. In some embodiments, the headwear is a headband, and a strap of the headband comprises the support base. In some embodiments, there are one or more fans 101. In some embodiments, there is a support base. In some embodiments, the mounting bracket 103 is connected to the support base. In some embodiments, the mounting bracket 103 additionally comprises a hinge 104. In some embodiments, an article of ventilating headwear comprises a support base, an article of headwear, a mounting bracket connected to the support base, the mounting bracket additionally comprising a hinge, one or more fans adjustably attached to the mounting bracket by the hinge, the one or more fans configured to blow air directly onto and over a user's nose, a power source, and a power switch.

In some embodiments, the headband straps 102 are made from an elastic fabric material. In other embodiments, the headband straps 102 may be an elastic, cloth, leather, or a synthetic material. In other embodiments, the headband straps 102 may be adjustable in length.

In some embodiments, the headband 102 has two straps, one encircling the head horizontally and one strap oriented vertically on the head. In other embodiments, the headband 102 may have one horizontal strap and no vertical strap. In other embodiments, the headband 102 may have more than one vertical strap and more than one horizontal strap. In other embodiments, the headband 102 may have more than one horizontal strap and no vertical strap.

In some embodiments, the electrical wiring 106 connecting to the power source 201 is connected to the fan across the vertical strap of the headband 102. In other embodiments, the electrical wiring 106 connecting to the power source 201 may be connected to the fan 101 across the one or more horizontal straps or the one or more horizontal straps and the one or more vertical straps of the headband 102. In some embodiments, the electrical wiring connecting the one or more fans to the power source may be connected across the headwear.

In some embodiments, there may be one or more fans 101 attached to the front of the headband 102 oriented so that air flow is directed downwards.

In some embodiments, the headwear may comprise an article of headwear such as, but not limited to, a hat, a baseball cap, a beanie, a hard hat, or a cowboy hat. In some embodiments, the support base is permanently affixed to the headwear. In some embodiments, the support base comprises a visor or brim of the hat.

Figure 2A:
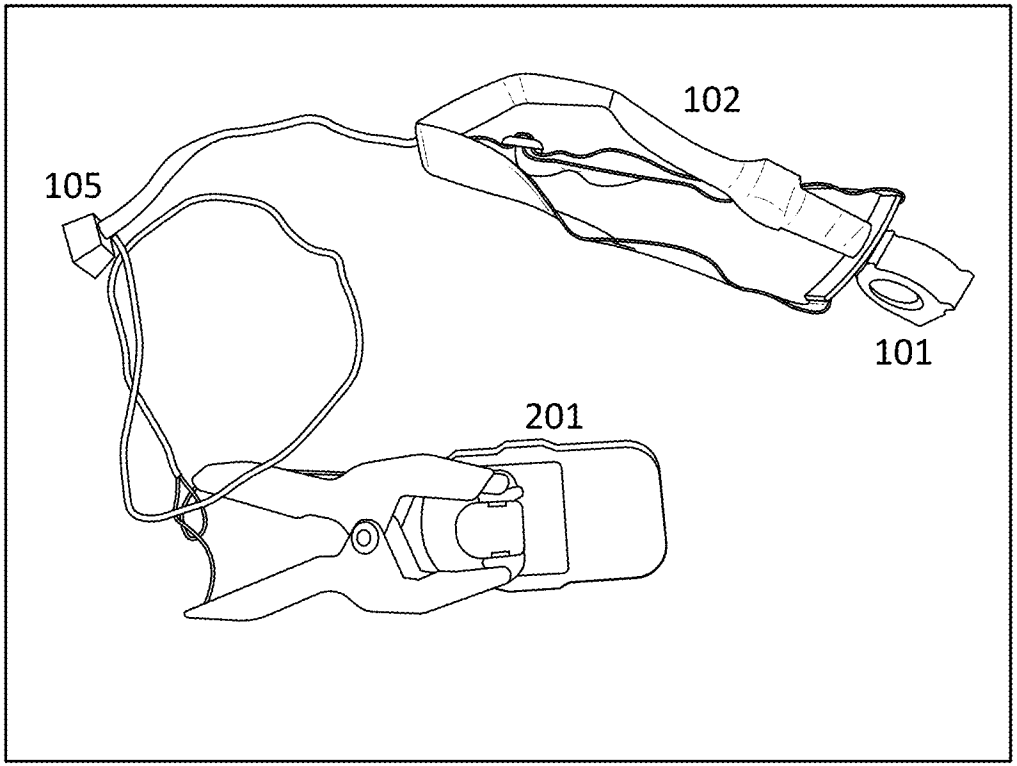
FIG. 2A shows an embodiment of a system comprising the fan of FIG. 1A with a power assembly as seen from the top.
Figure 2B:
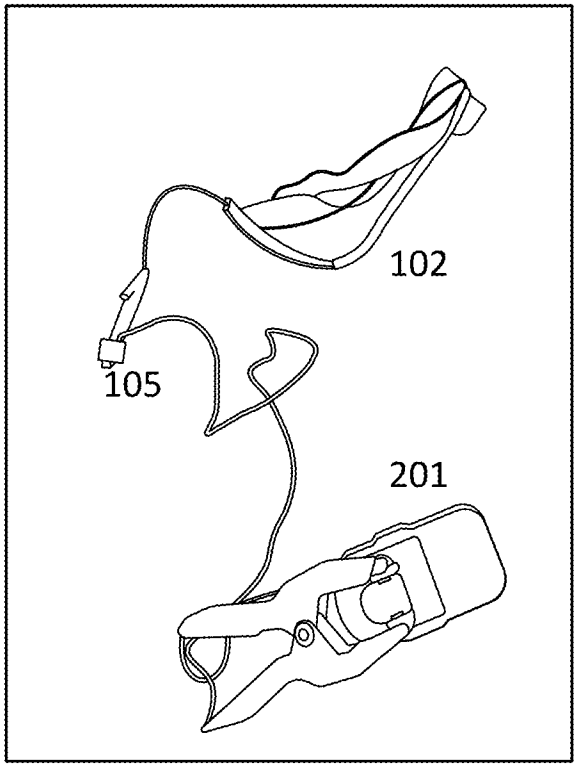
FIG. 2B shows the system of FIG. 2A as seen from the side.

FIGS. 2A and 2B show an embodiment of a headband mounted fan connected to a power source 201 from the top and side, respectively. In this embodiment, the power source 201 is an external battery. In other embodiments, the power source 201 may be an internal battery. In other embodiments, the power source 201 may be connected to a solar panel.

Figure 3A:
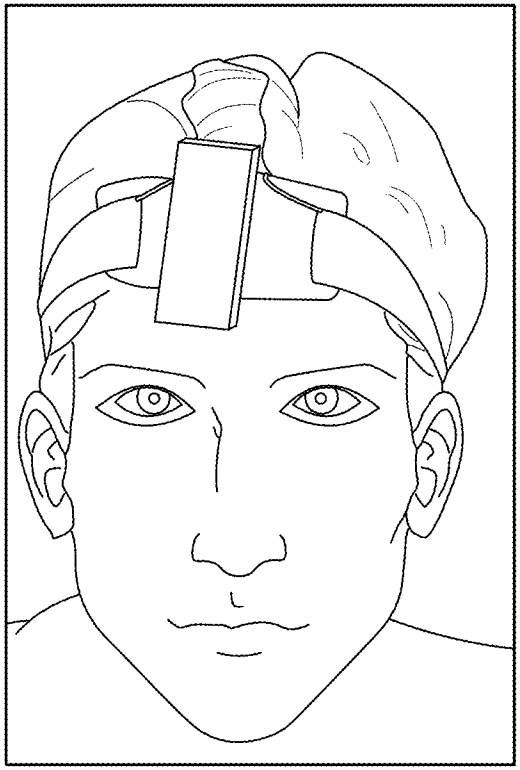
FIG. 3A shows the system of FIG. 2A as seen from the front.
Figure 3B:
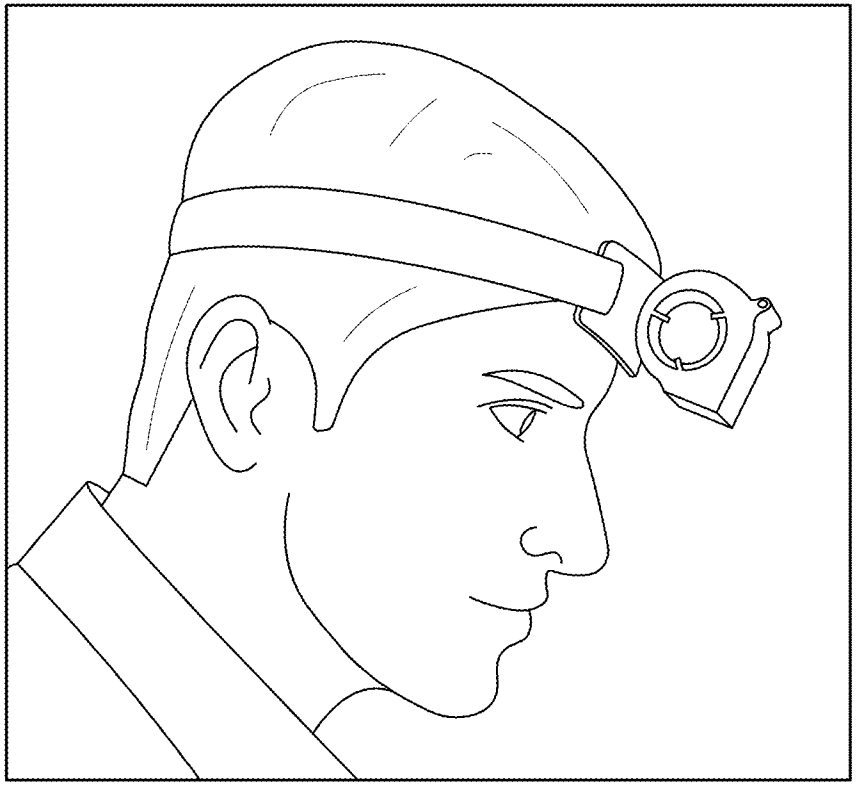
FIG. 3B shows the system of FIG. 2A worn by an individual as seen from the side.

FIGS. 3A and 3B show an embodiment of a headband mounted fan as worn by an individual seen from the front and the side, respectively. In this embodiment, the singular fan 101 is located at the center of the headband 102 where the horizontal and vertical straps meet. In some embodiments, one or more fans 101 may be attached to the center of the headband 102 where the horizontal and vertical straps meet. In some embodiments, one or more fans 101 may be attached to the center of the front of the headwear.

Figure 4A:
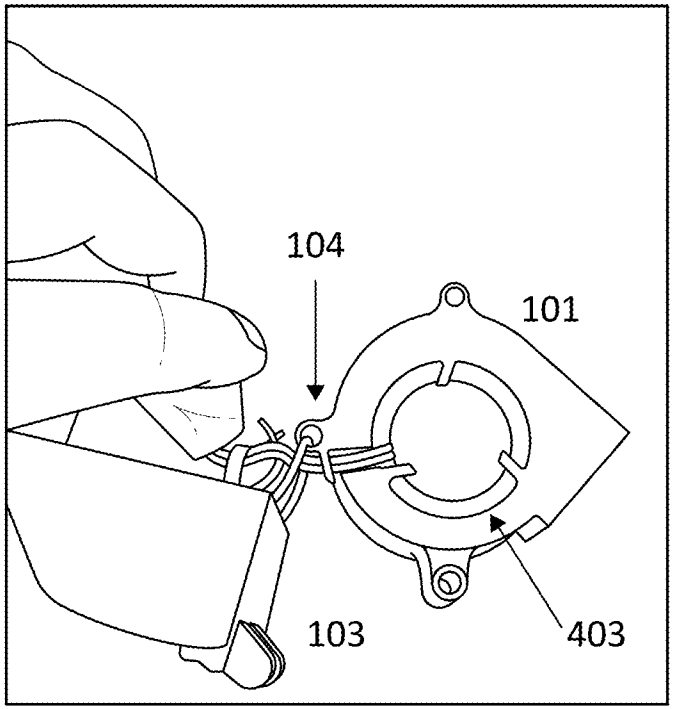
FIG. 4A shows a side view of the fan and a mounting bracket of the embodiment of FIG. 2A.
Figure 4B:
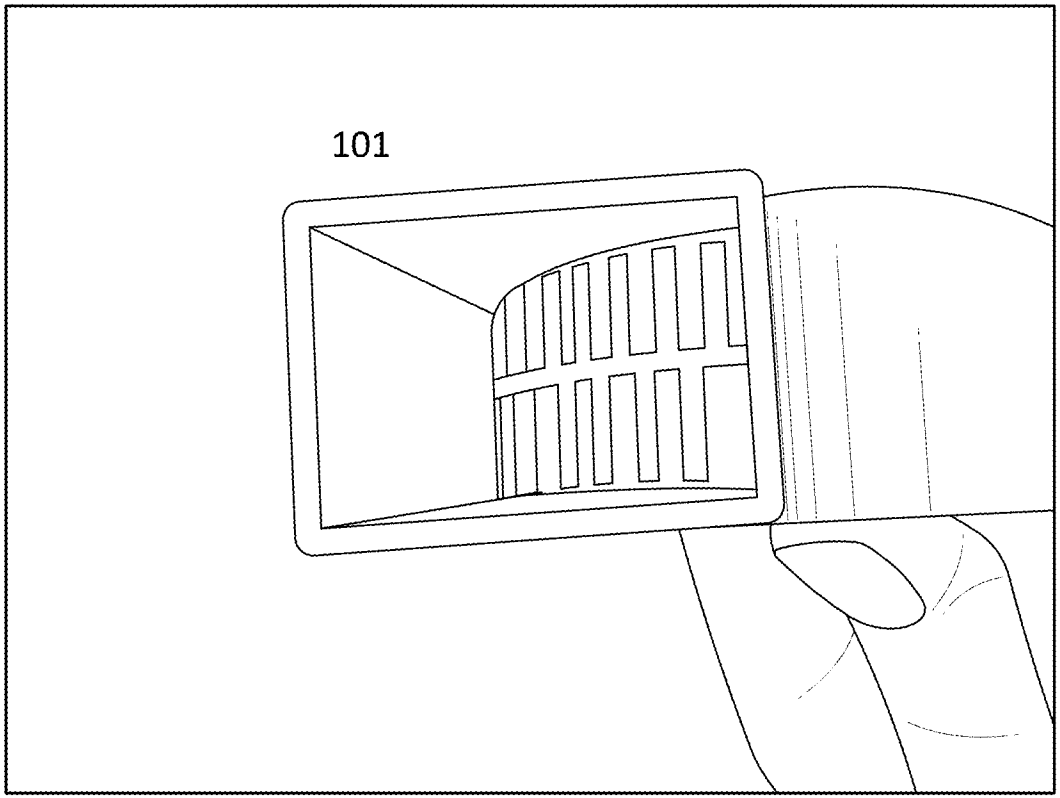
FIG. 4B shows the fan of the system of FIG. 2A as seen from the bottom.

FIGS. 4A and 4B show an embodiment of a fan 101 and mounting bracket 103 with a hinge 104 from the side and the bottom, respectively. In this embodiment, the fan 101 is adjustably mounted to a plastic mounting bracket 103 by a hinge 104 attached to the headband 102. In other embodiments, the mounting bracket 103 may be wood, metal, or a synthetic material.

In various embodiments, the air flowing from the one or more fans can be directed at an angle slightly away from the user's face. For example, relative to vertical, the airflow can be directed at an angle of at least about: 10 degrees, 15 degrees, 20 degrees, 25 degrees, 30 degrees, or 45 degrees. The one or more fans 101 can be adjustable in orientation. For example, the one or more fans can be configured to rotate by the hinge 104. In other embodiments, the one or more fans 101 may rotate by the hinge 104 with respect to the headband 102 and/or the user's nose. In some embodiments, the range of rotation would be from 0 degrees to 90 degrees. In some embodiments, the range of rotation would be from 0 degrees to 45 degrees. In some embodiments, the range of rotation would be from 0 degrees to 30 degrees. In some embodiments, the range of rotation would be from 0 degrees to 15 degrees. In some embodiments, the one or more fans are adjustable such that the direction of the air exiting the one or more fans are generally parallel to the slope of the user's nose, is aimed at or in front of the user's nose (e.g., at or in front of the tip of the user's nose), is non-perpendicular to the bill of the headwear, or otherwise. In some embodiments, the hinge 104 may be locked into certain orientations, such as through a ratchet or other locking system. An orientation adjustable fan allows the user to lock into an ideal air flow vector for their face, maximizing the overall efficiency of the dispersal of particulate matter and noxious vapors from the user's face. An orientation adjustable fan provides a significant advantage over an orientation fixed fan (e.g., a fan fixed to the bill of a cap), such in order to allow the fan to be properly positioned (e.g., to direct the flow of air at or in front of the nose) when different people wear the headwear.

Air flow from the one or more fans 101 passes air over and/or around the nasal cavity. This is believed to create eddies in the air flow around the nasal cavity, such as eddies below the user's nose and/or above the user's mouth. The air flow passing down over the user's nose can create an eddy below the nose, which can provide a localized pocket of higher pressure air (relative to the moving air around it) adjacent the user's nostrils, which the user may perceive as making breathing easier, conveying heat (e.g., away from the user), and/or providing refreshment. In some implementations, the air flows over the user's nose. In some embodiments, the air passes in front of the user's nose, such as a distance from the tip of the user's nose of less than or equal to approximately: ½ inch, ¼ inch, ⅛ inch, 1/16 inch, or otherwise. In some embodiments, the air flows directly onto the tip of the user's nose.

In some embodiments, the speed of the one or more fans 101 may be adjustable. In some embodiments, the fan speed may range from 500 rpm to 5000 rpm. Adjustable fan speeds allow for the user to regulate air flow from the fan, giving the user control over particulate and vapor dispersal rates. Stronger air flow rates would ideally lead to greater vapor and particulate dispersal. In addition, strong flow rates dispersing noxious vapors and particulate matter may contribute to a reduction in nasal congestion, correlating with a reduction in snoring for the user. The air flow across the user's face is additionally believed to reduce the user's airborne intake of microbes such as viruses and bacteria. In some embodiments, the power switch 105 may be a capacitive switch.

In some embodiments, the air intake section 403 of the one or more fans 101 may have a removable filter attached. Attaching a removable filter to the air intake section 403 would help prevent particulate matter from accumulating in the fan and potentially being blown into the user's face. In some embodiments, the air intake section 403 of the fan 101 may be oriented on the sides perpendicular to the exit air flow of the fan. Orienting the air intake sections on the side of the fan as opposed to the top of the fan would aid safety, limiting the potential for hair or debris from getting caught in the fan.

Figure 5:
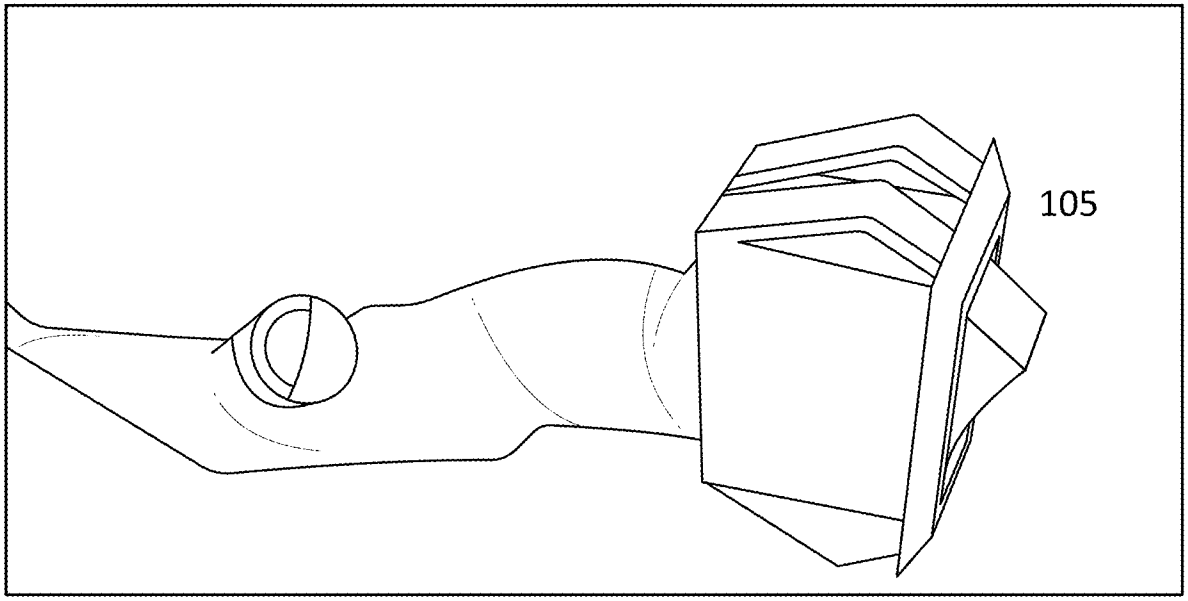
FIG. 5 shows a power switch assembly of the embodiment of FIG. 2A.

FIG. 5 shows an embodiment of the power switch 105 to activate the fan. In other embodiments, the power switch 105 may be located on the headband 102, on the fan 101, or on the power source 201.

Figure 6:
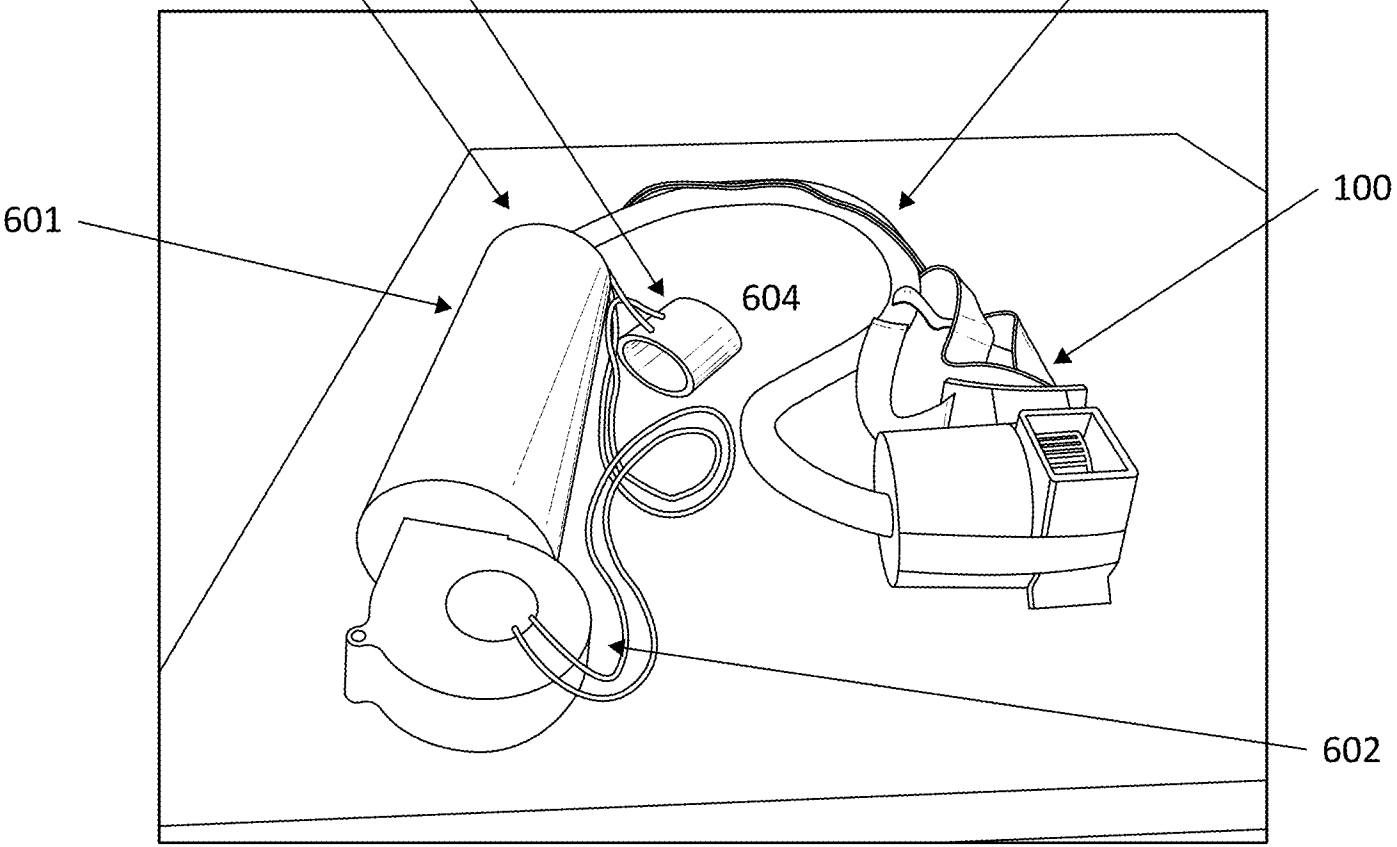
FIG. 6 is an embodiment of a headwear mounted fan with a filter attachment.
Figure 7A:
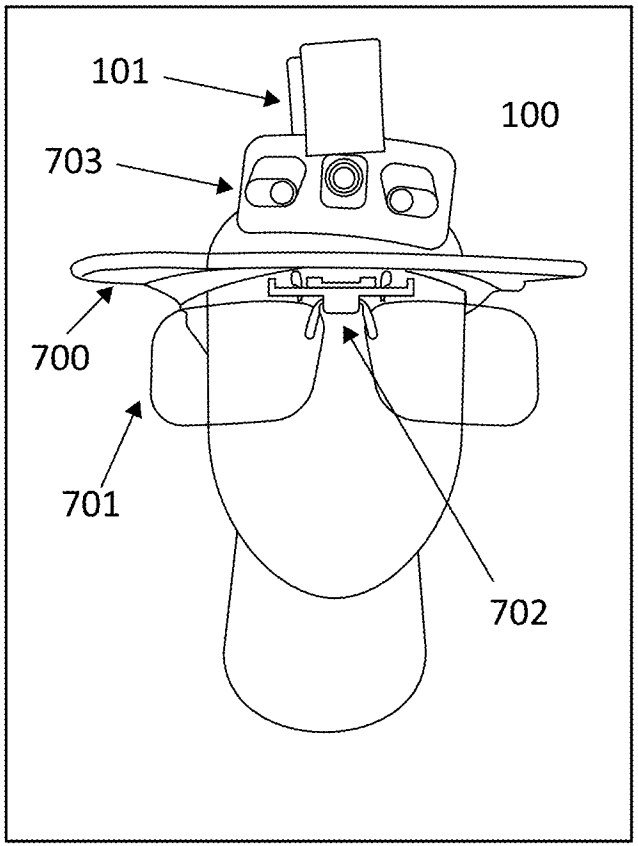
FIG. 7A shows an embodiment of a headwear mounted fan with a visor, light, and eye protection as seen from the front.
Figure 7B:
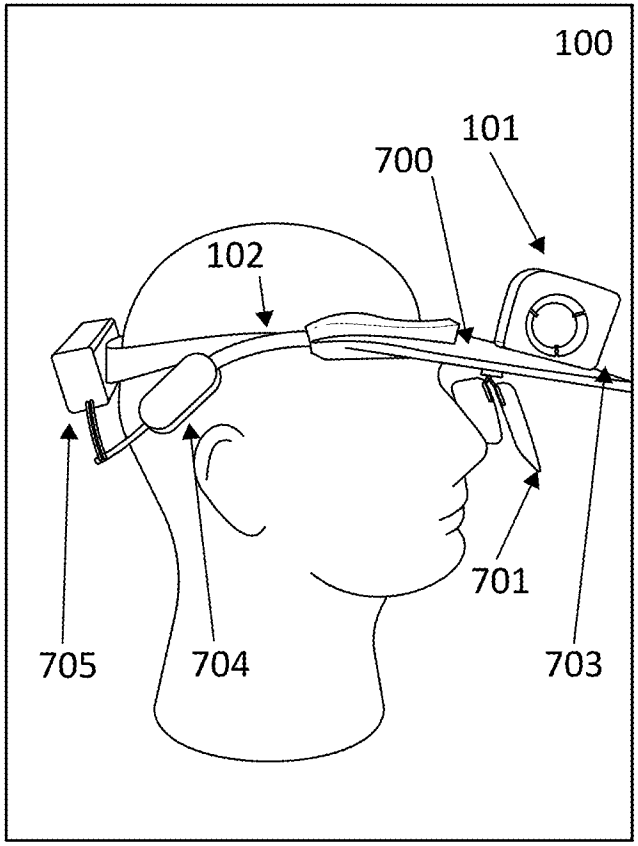
FIG. 7B shows the embodiment of FIG. 7A as seen from the side.
Figure 7C:
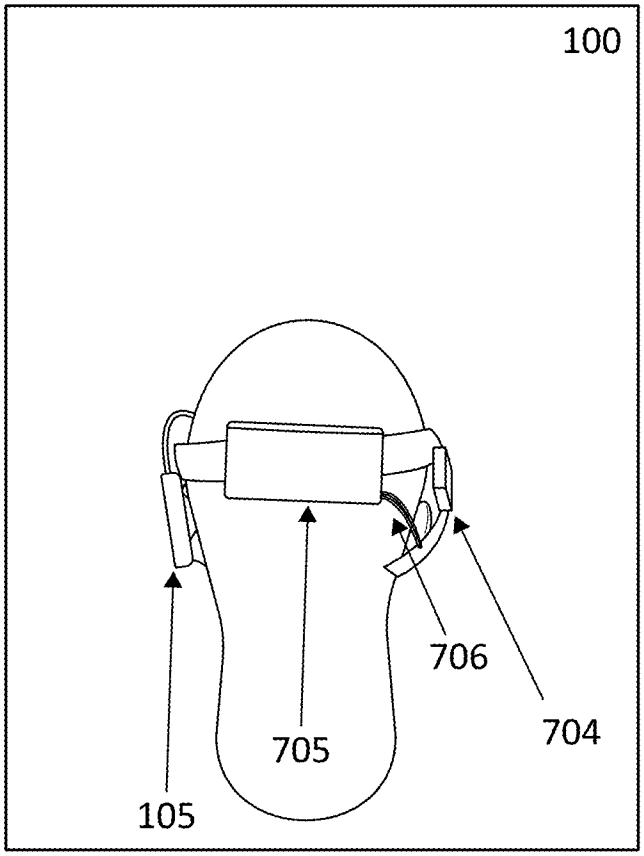
FIG. 7C shows the embodiment of FIG. 7A as seen from the back.
Figure 7D:
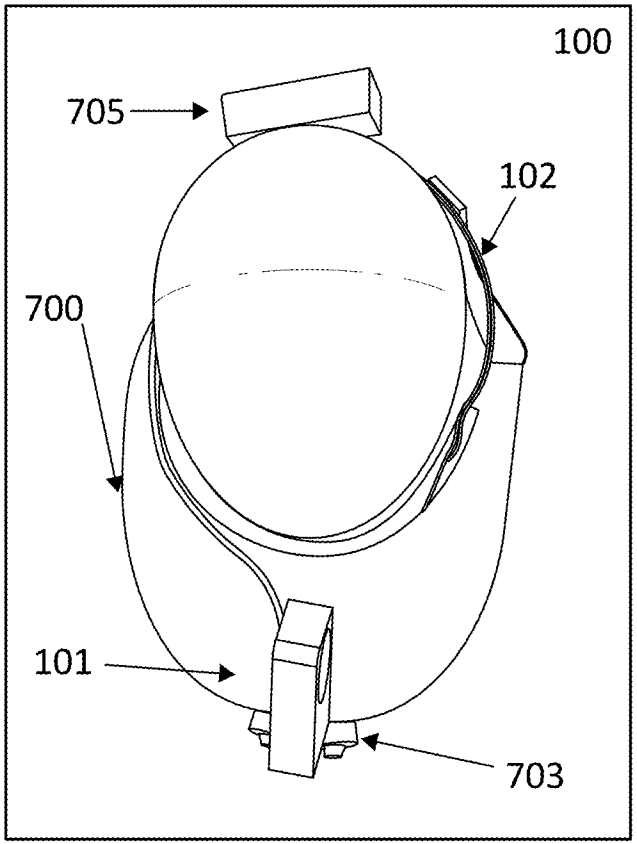
FIG. 7D shows the embodiment of FIG. 7A as seen from the top.
Figure 8A:
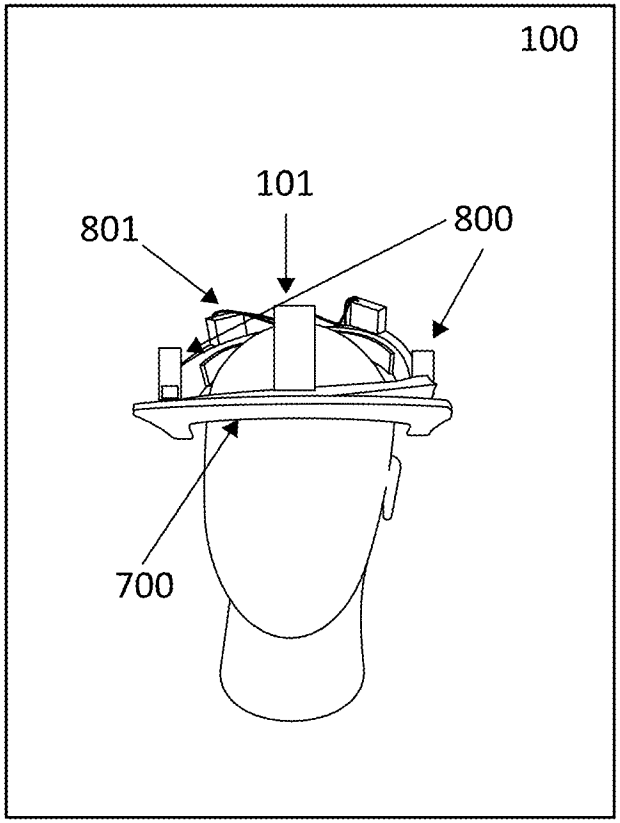
FIG. 8A is an embodiment of a headband mounted fan with a visor and fans over each ear as seen from the front.
Figure 8B:
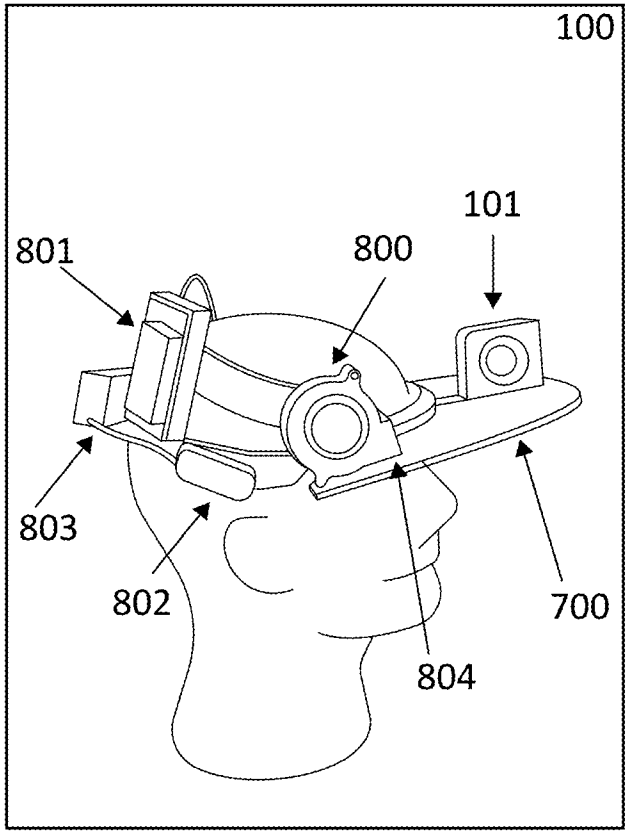
FIG. 8B shows the embodiment of FIG. 8A as seen from the left.
Figure 8C:
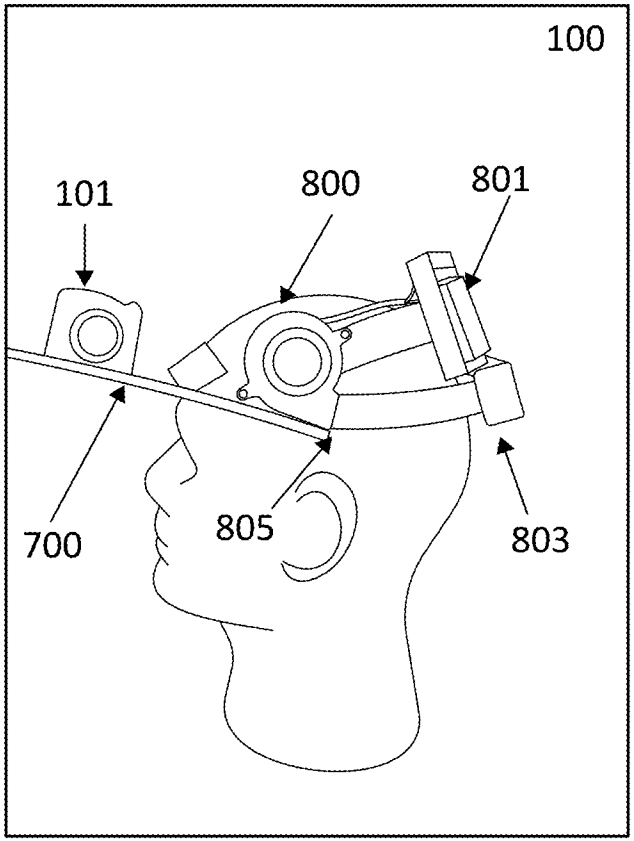
FIG. 8C shows the embodiment of FIG. 8A as seen from the right.
Figure 8D:
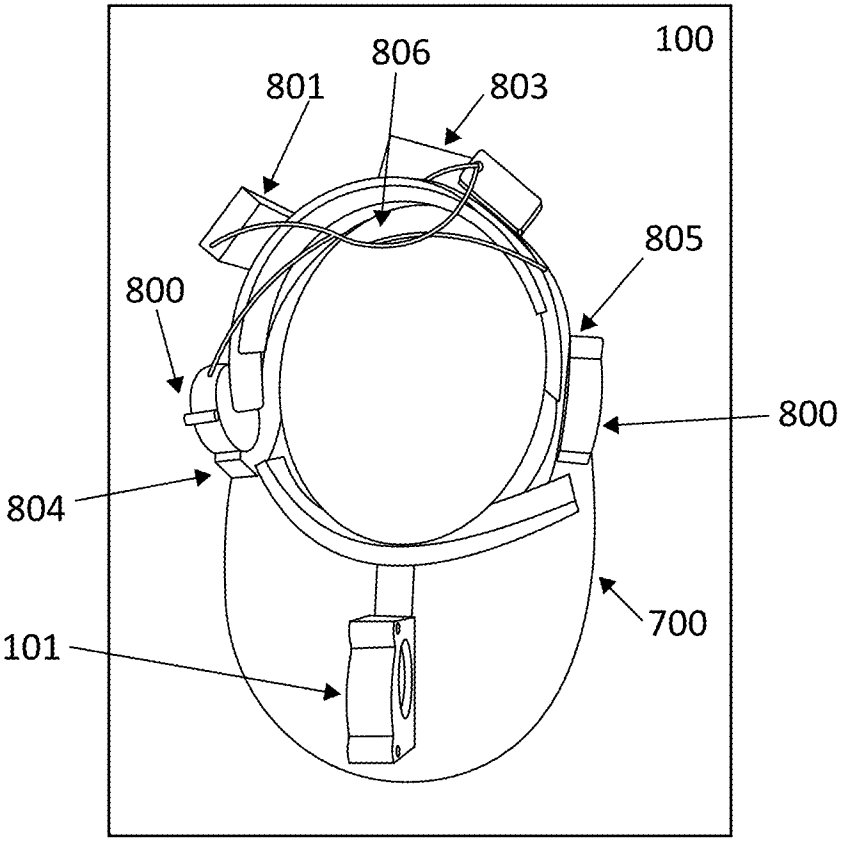
FIG. 8D shows the embodiment of FIG. 8A as seen from the top.
Figure 8E:
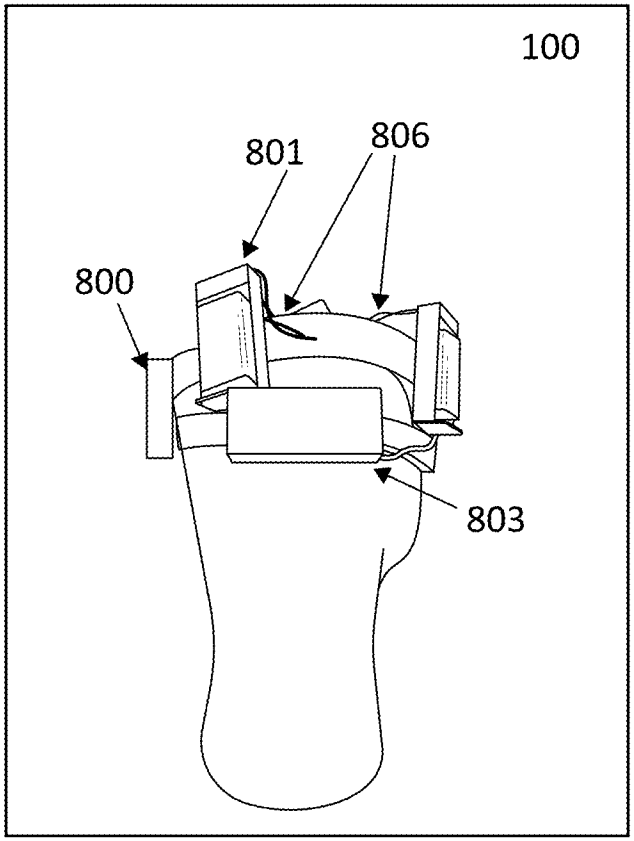
FIG. 8E shows the embodiment of FIG. 8A as seen from the back.

FIG. 6 shows an embodiment of the headband mounted fan device 100 with a removably attached filter module 600, such as a canister. In some embodiments, the filter module 600 may be attached to the user's belt, to the user's back, to the user's arm, incorporated onto the headband device 100, or otherwise. The filter module 600 can comprise a container, canister, tube or otherwise. The filter module 600 can be hollow. At least one end of the filter module 600 can configured to open and close.

The filter module 600 can include a filter body 601. In some embodiments, the filter body 601 may contain one or more removable filter materials such as cotton, spun fiberglass, activated carbon, plastic, and anti-microbial materials. The filter body 601 can be removably contained in the filter module 600.

Air flow through the filter body 601 can be generated by a fan 602. The fan 602 may be powered either through the power source 201 or through another power source 604. In some embodiments, the power source 604 may be a battery or a power-generating source such as a solar panel. The air flow through the filter body 601 can be directed to the air intake of the one or more fans 101 of the headband mounted fan 100, such as through tubing 603. In some embodiments, the tubing 603 may be a flexible plastic, leather, or synthetic material.

In some embodiments, the fan 602 is removably attached to the filter body 601. A removable fan 602 facilitates replacement and/or removal of filter materials contained within the filter body 601. In some embodiments, the fan speeds of the fan 602 may be adjustable, allowing for different air flow rates through the filter body 601. In certain embodiments, the fan 602 may have a single and/or substantially constant fan speed. In some embodiments, the fan 602 can comprise a variable speed.

The device 100 may have a sensor (e.g., to detect an air pressure drop across the filter body 601) to allow the user to more easily identify when the filter material within the filter body 601 is dirty or needs to be replaced. In some embodiments, the output of the sensor is used to control the fan 602. For example, the fan 602 can be controlled to operate at a higher speed (to push more air through the filter body 601) in response a greater pressure drop across the filter body 601. The fan 602 can be controlled by a controller (e.g., an electronic processor and a memory) in operable communication with the sensor and fan.

FIGS. 7A-7D show an embodiment of the headband mounted fan device 100 with a visor 700 bound to headband 102, eye protection 701 mounted on one or more adjustable rails 702 with one or more lights 703. In some embodiments, the visor 700 may comprise wood, plastic, leather, fabric, or a composite material.

In some embodiments, the eye protection 701 may be polarized. In some embodiments, the eye protection 701 may wrap around the user's face. In some embodiments, the eye protection 701 may resemble safety glasses or safety goggles. In some embodiments, the eye protection 701 may be glass, plastic, or a composite material. In some embodiments, the eye protection 701 may be prescription eyewear. In some embodiments, the eye protection 701 may be a face shield.

In some embodiments, the eye protection 701 may be mounted on one or more adjustable rails 702. This can allow the eye protection to move up and down the user's face. This movement would allow for greater safety for the user, granting a better adjustable fit and giving the user more protection from particulates or vapors. In some embodiments, the one or more adjustable rails 702 may be mounted onto the visor 700. For example, the one or more adjustable rails 702 can pass through an aperture in the visor 700. In some embodiments, the one or more adjustable rails 702 may be mounted onto the headband 102. The adjustable rails 702 may be configured to enable the eye protection 701 to be moved relative to the visor 700, such as in a generally vertical direction. For example, the eye protection 701 can be slid on the adjustable rails 702. This can allow the eye protection 701 to be moved into and/or out of the user's field of view. The eye protection 701 can be rotated relative to the visor 700, such as being able to be flipped down (the position in FIG. 7B) or up (to a position approximately 90 degrees from the position in FIG. 7B).

In some embodiments, the one or more lights 703 may be located on the brim of the visor 700, or may be spaced out at intervals around the visor 700, or may be spaced out at intervals around the visor 700 and the headband 102. In some embodiments, the one or more lights 703 may be turned on and off with a switch 704 apart from the switch that turns the one or more fans 101 on and off. In some embodiments, the one or more lights 703 may be turned on and off with a capacitive switch 704. In some embodiments, the one or more lights 703 may have a power source 705 apart from the power source 201 that powers the one or more fans 101. In these embodiments, the power source 705 is connected to switch 704 through wiring 706.

FIGS. 8A-8E show an embodiment of the headband mounted fan device 100 with a visor 700 bound to headband 102, two or more fans 800 located over the user's ears, and a separate power source 801 to power the two or more fans 800. For example, a shown, a fan can be located near or over each of the user's ears. In some embodiments, the exit air flow of the two or more fans 800 face in opposite directions. In some embodiments, the exit air flow of the two or more fans 800 from exit ports 804 and 805 face towards the front and back of the user's head. This is believed to create a vortex effect, which can reduce exposure to and/or protect the wearer from dust and contaminants.

In some embodiments, the two or more fans 800, or any of the fans in any of the embodiments of this disclosure, may have adjustable speeds. The adjustable speed can be, for example, between approximately 500 to approximately 5,000 rotations per minute. In some embodiments, the two or more fans 800 may be attached to the headband 102.

In some embodiments, the two or more fans 800 may be attached to the visor 700. In some embodiments, the two or more fans 800 may be powered by a power source 801 separate from the power source 803 that powers the one or more fans 101. In these embodiments, the power source 801 is connected to the two or more fans 800 through wiring 806. In some embodiments, the two or more fans 800 are turned on and off by a power switch 802 separate from the power switch 105 that turns on and off the one or more fans 101. In some embodiments, the power switch 802 is a capacitive switch.

In some embodiments, the two or more fans 800 may be removably attached to one or more filters 600 (see FIG. 6). In some embodiments, the filter module 600 attached to the two or more fans 800 may be attached to the user's belt, to the user's back, to the user's arm, incorporated onto the headband device 100, or otherwise. The filter module 600 attached to the two or more fans 800 can comprise a container, canister, tube or otherwise. The filter module 600 attached to the two or more fans 800 can be hollow. At least one end of the filter module 600 can configured to open and close.

The filter module 600 attached to the two or more fans 800 can include a filter body 601. In some embodiments, the filter body 601 may contain one or more removable filter materials such as cotton, spun fiberglass, activated carbon, plastic, and anti-microbial materials. The filter body 601 can be removably contained in the filter module 600 attached to the two or more fans 800.

Air flow through the filter body 601 can be generated by a fan 602. The fan 602 may be powered either through the power source 201 or through another power source 604. In some embodiments, the power source 604 may be a battery or a power-generating source such as a solar panel. The air flow through the filter body 601 can be directed to the air intake of the one or more fans 101 of the headband mounted fan 100, such as through tubing 603. In some embodiments, the tubing 603 may be a flexible plastic, leather, or synthetic material.

In some embodiments, the fan 602 is removably attached to the filter body 601. A removable fan 602 facilitates replacement and/or removal of filter materials contained within the filter body 601. In some embodiments, the fan speeds of the fan 602 may be adjustable, allowing for different air flow rates through the filter body 601. In certain embodiments, the fan 602 may have a single and/or substantially constant fan speed. In some embodiments, the fan 602 can comprise a variable speed.

The device 100 may have a sensor (e.g., to detect an air pressure drop across the filter body 601) to allow the user to more easily identify when the filter material within the filter body 601 is dirty or needs to be replaced. In some embodiments, the output of the sensor is used to control the fan 602. For example, the fan 602 can be controlled to operate at a higher speed (to push more air through the filter body 601) in response a greater pressure drop across the filter body 601. The fan 602 can be controlled by a controller (e.g., an electronic processor and a memory) in operable communication with the sensor and fan.

In some embodiments, the support base, power switch 105, and power source 201 are each removably attached to the headwear by one or more magnets. Having the power switch 105, the power source 201, and the support base, which is connected to the mounting bracket 103 and the one or more fans 101, forming a portable fan system in total, each removably attached to the headwear by one or more magnets allows the fan system to be portable in nature. The portable fan system, by nature of the one or more magnets, could be attached to any headwear, moving from one article of headwear to another at the user's desire. In some embodiments, one or more magnets may be permanently affixed to the power source 201, the power switch 105, the one or more fans 101, the mounting bracket 103, and/or the support base. In some embodiments, one or more magnets may be removably affixed to the power switch 105, the support base, the one or more fans 101, the mounting bracket 103, and/or the power source 201. In some embodiments, one or more magnets may be removably affixed to the power switch 105, the support base, the one or more fans 101, the mounting bracket 103, and/or the power source 201 by means such as one or more clips, Velcro, one or more snaps, one or more pins, one or more straps, and/or one or more elastic bands.

In some embodiments, the one or more magnets may be permanently affixed to the headwear. In some embodiments, the one or more magnets may be removably attached to the headwear. In some embodiments, the one or more magnets connected to the support base may be attached to the front of the headwear. In some embodiments, the one or more magnets connected to the power source 201 and power switch 105 may be attached to the rear of the headwear. In some embodiments, the one or more magnets connected to the power source 201 and power switch 105 may be attached to the front of the headwear. In some embodiments, the one or more magnets connected to the power source 201 and power switch 105 may be attached to the left side or the right side of the headwear. In some embodiments, the power source 201, power switch 105, and mounting bracket 103, which is connected to the one or more fans 101, are each be removably attached to the headwear by one or more magnets.

FIG. 9A-9F depict another embodiment of a headwear mounted fan system. The system can include any of the features of the other embodiments disclosed herein. The system can include a fan 900 and a power source 901, such as a battery. The fan 900 can be operably coupled to the power source 901 by writing 906. In some embodiments, the fan 900 is controlled with a remote 951 (see FIG. 9F), such as to control on/off, fan speed, set an operating timer, etc.

The system can include connection elements, such as an upper strap 952 and a lower strap 953. The straps 952, 953 can each include an associated magnetic 954. The respective magnets on the straps can be configured to attract each other by magnetic force. As discussed below, the straps 952, 953 can enable the system to be mounted to and/or removed from an article of headwear.

Figure 9A:
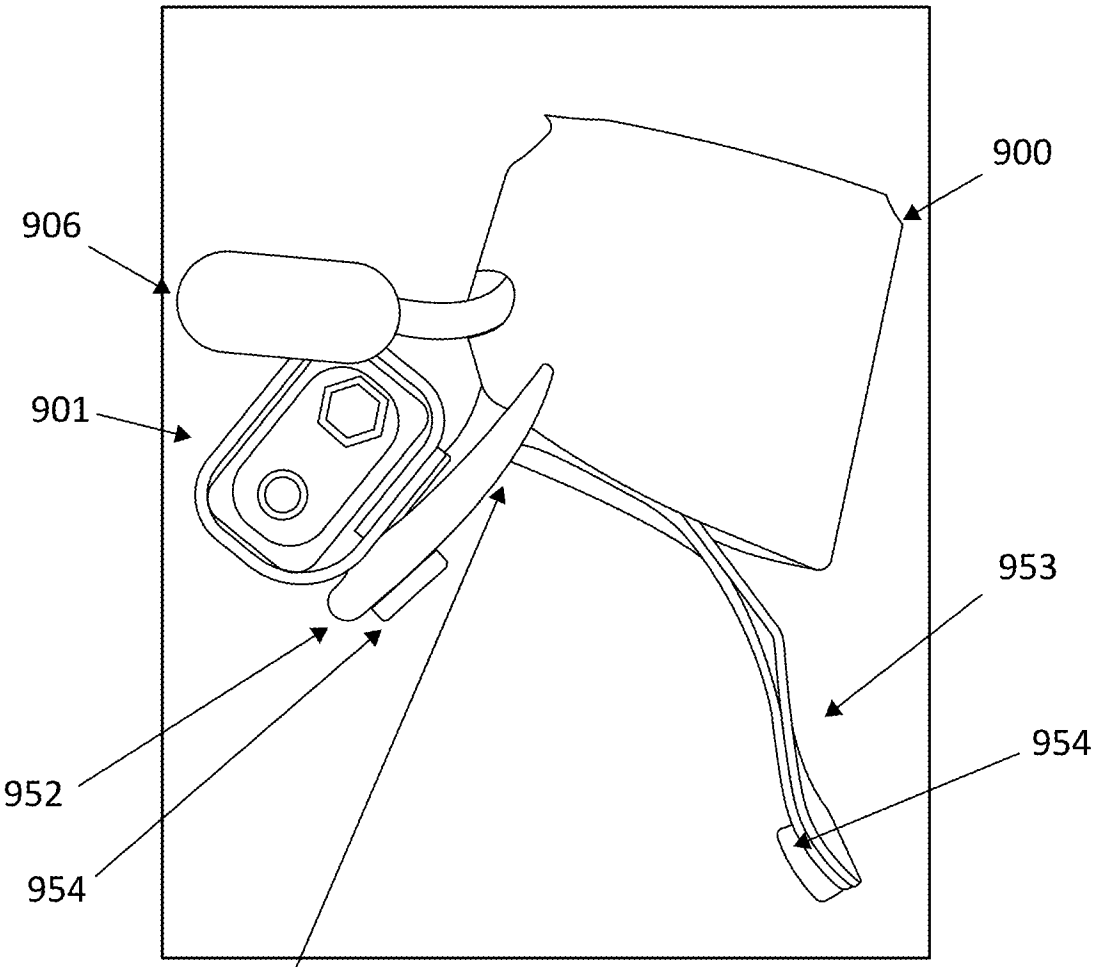
FIG. 9A shows an embodiment of a removable and/or detachable headwear mounted fan and power source.
Figure 9B:
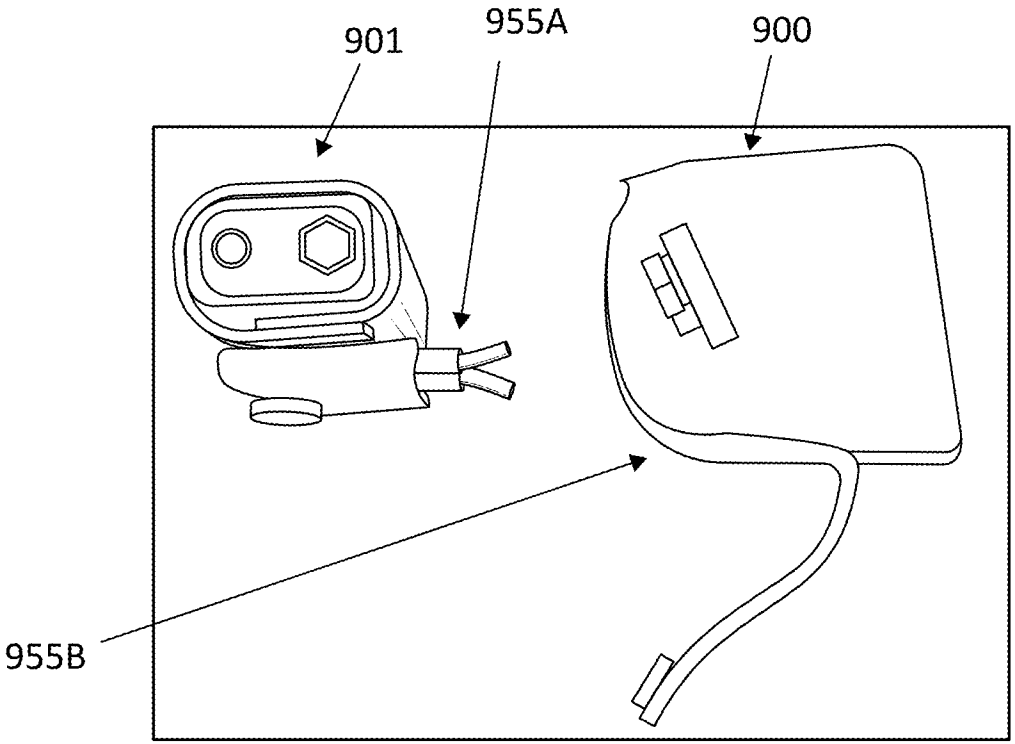
FIG. 9B shows the embodiment of FIG. 9A with the fan and power source detached.

As shown in FIGS. 9A and 9B, the system can include a joint 955. The joint 955 can comprise a first element 955A, such as a knuckle or male component. The joint 955 can comprise a second element 955A, such as a hole or female component. The first element can be configured to mate with (e.g., be received in) the second element. In various embodiments, the first element is fixed to the power source 901 and the second element is fixed to the fan 900. The joint can be configured to enable the fan 900 to move (e.g., pivot) relative to the power source 901. In some embodiments, the joint is separable. For example, the first element can be configured to detach from the second element. This can allow the fan 900 to be detached from the power source 901, as shown in FIG. 9B.

Figure 9D:
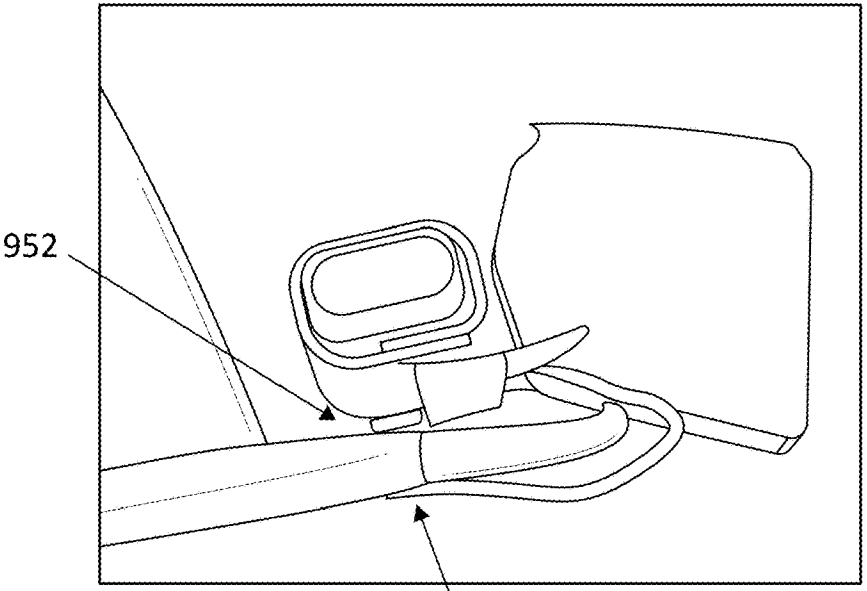
FIGS. 9C and 9D show the embodiment of FIG. 9A in separated and connected states, respectively, with regard to the brim of an article of headwear.
Figure 9C:
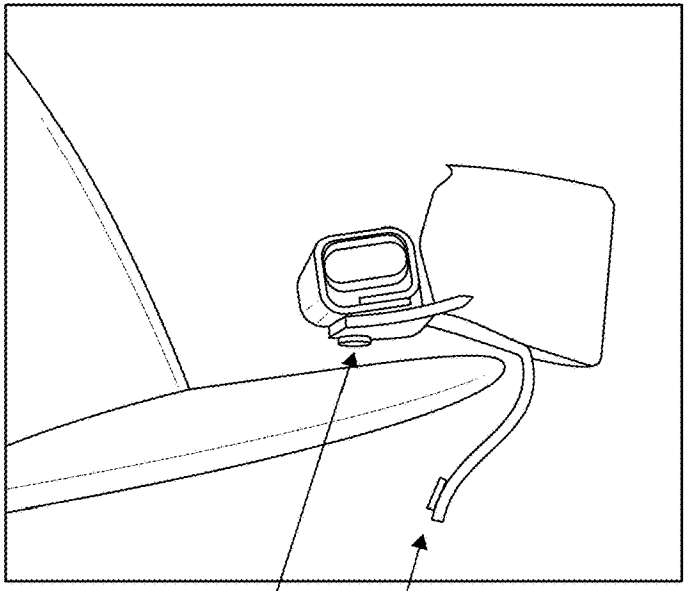

FIGS. 9C and 9D show the system in separated and connected states, respectively, with regard to the brim of an article of headwear, such as hat. As shown in FIG. 9C, the straps 952, 953 can respectively be positioned above and below the brim of the hat. Due to the attraction of the magnets 954, a pinching force is exerted on the brim. This can enable the system to be secured to the brim of the hat. Further, this arrangement can allow the user to vary the position the system on the brim, such as to accommodate the user's preferences, to aim the airflow out of the fan 900, etc. Moreover, the system can be readily detached from the hat by decoupling the magnets, which allows the system to be stored, moved to another article of headwear, etc.

Figure 9F:
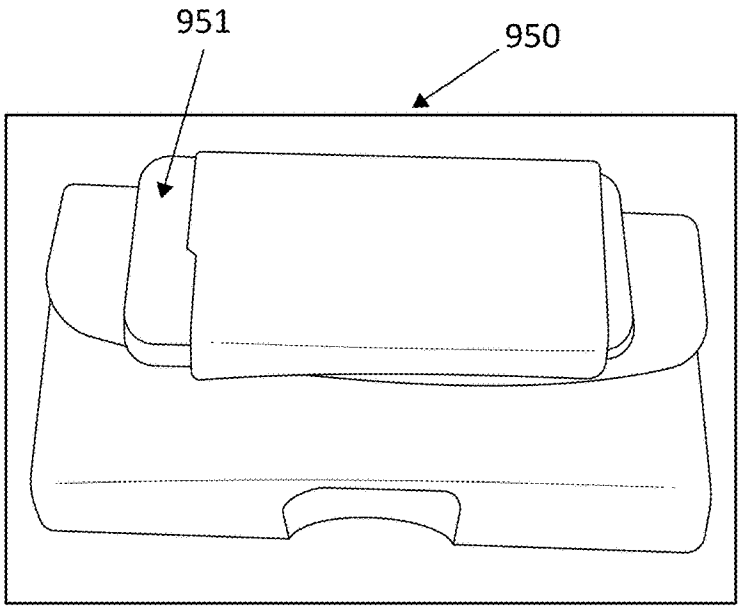
FIGS. 9E and 9F show a kit (e.g., case) comprising the embodiment of FIG. 9A.
Figure 9E:
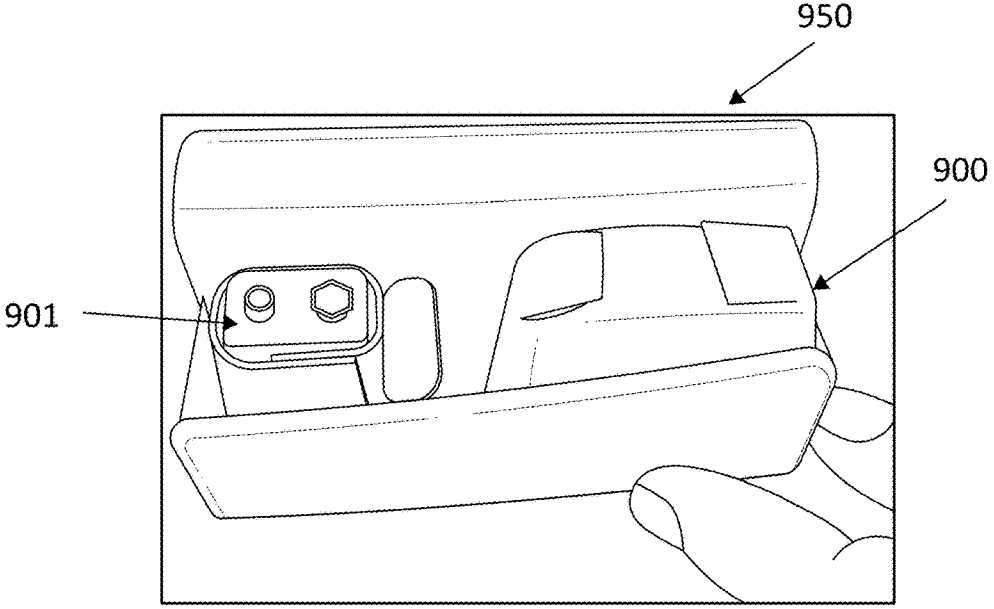

FIGS. 9E and 9F show a kit 950 (e.g., case) comprising the system. In some embodiments, the kit 950 can hold and/or secure the fan 900 and power source 901 in dedicated compartments. The kit 950 can include a flap or other mechanism for closing the kit 950. In some embodiments, the kit 950 holds the remote 951, such as is shown in FIG. 9F.

While certain embodiments have been described, these embodiments have been presented by way of example only and are not intended to limit the scope of the disclosure. Indeed, the novel devices described herein may be embodied in a variety of other forms. Furthermore, various omissions, substitutions and changes in the systems and methods described herein may be made without departing from the spirit of the disclosure.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Certain terminology may be used in the following description for the purpose of reference only, and thus is not intended to be limiting. For example, terms such as "upper", "lower", "upward", "downward", "above", "below", "top", "bottom", "left", and similar terms refer to directions in the drawings to which reference is made. Such terminology may include the words specifically mentioned above, derivatives thereof, and words of similar import. Similarly, the terms "first", "second", and other such numerical terms referring to structures neither imply a sequence or order unless clearly indicated by the context.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "spherical" or "circular" or "cylindrical" or "semi-circular" or "semi-cylindrical" or any related or similar terms, are not required to conform strictly to the mathematical definitions of spheres, circles, cylinders or other structures, but can encompass structures that are reasonably close approximations.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees. As another example, in certain embodiments, as the context may permit, the term "generally perpendicular" can refer to something that departs from exactly perpendicular by less than or equal to 20 degrees. As used in this disclosure, the term "vertical" is synonymous with "generally vertical" and the term "horizontal" is synonymous with "generally horizontal," and the terms "generally vertical" and "generally horizontal" respectively refer to something that departs from exactly vertical or horizontal by less than or equal to 20 degrees.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed and/or rearranged. Further, the disclosure herein of any particular feature, aspect, method, property, characteristic, quality, attribute, element or the like in connection with various embodiments can be used in all other embodiments set forth herein. Additionally, any methods described herein may be practiced using any device suitable for performing the recited steps.

Various wearable air flow safety systems have been described and illustrated. Although this invention has been disclosed in the context of certain embodiments and examples, the scope of this disclosure extends beyond the specifically disclosed embodiments to other alternative embodiments and/or uses of the invention and obvious modifications and equivalents thereof. Any system, method, and device described in this application can include any combination of the preceding features described in this and other paragraphs, among other features and combinations described herein, including features and combinations described in subsequent paragraphs. While several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with or substituted for, one another in order to form varying modes of the disclosed invention.

Overall, it is intended that the scope of the present invention herein disclosed should not be limited by the particular disclosed embodiments described above, but should be determined only by a fair reading of the claims that follow.

What is claimed is:

1. A ventilating headband comprising:

a front;

a right strap configured to extend from the front around a portion of a right side of a user's head;

a left strap configured to extend from the front around a portion of a left side of the user's head;

a top strap configured to extend from the front and in a rearward direction over a portion of a top of the user's head;

a mounting bracket connected to the right strap, the left strap, and the top strap, the mounting bracket comprising a rigid plastic plate configured to be worn against the user's forehead, the mounting bracket additionally comprising a hinge;

a fan adjustably attached to the mounting bracket by the hinge, the fan comprising a closed top, a first air inlet on a right side of the fan, a second air inlet on a left side of the fan opposite the right side of the fan, and an outlet on the bottom, the fan configured to blow air from the outlet directly onto and over the user's nose;

a first filter removably attached to at first air inlet and a second filter removably attached to at second air inlet, the first and second filters configured to filter air entering the fan through the first and second air inlets;

a power source positioned on the top strap such that the power source is rearward of the apex of the user's head;

wiring connecting the power source to the fan, the wiring extending along the top strap between the power source and the fan;

a power switch; and a remote control configured to control the fan.

2. The headband of claim 1, wherein the fan may be adjusted to a fixed angle away from the mounting bracket between five degrees to thirty degrees.

3. The headband of claim 1, wherein the mounting bracket is constructed from either wood, metal, plastic, or a synthetic material.

4. The headband of claim 1, wherein a speed of the fan can be adjusted.

5. The headband of claim 4, wherein the speed of the fan can be adjusted in a range of 500 to 5000 rotations per minute.

6. The headband of claim 1, wherein the first and second air inlets of the fan are located perpendicular to an exit air flow of the fan.

7. The headband of claim 1, further comprising eye protection.

8. The headband of claim 7, wherein the eye protection is mounted onto a visor.

9. The headband of claim 8, wherein the eye protection is mounted onto the visor by one or more adjustable rails such that the eye protection is slidable and rotatable relative to the visor.

10. The headband of claim 1, further comprising a second fan positioned over the user's right ear and a third fan positioned over the user's left ear.

11. The headband of claim 10, wherein the second and third fans are facing in opposing directions.

12. The headband of claim 10, wherein an exit air flow of the second fan is oriented to blow air forward relative to the user, and an exit air flow of the third fan is oriented to blow air rearward relative to the user.

13. The headband of claim 10, wherein air intake sections of the second and third fans are located perpendicular to exit air flow of the second and third fans.

14. The headband of claim 1, wherein the fan comprises a plurality of vanes configured to rotate around an axis of rotation, the axis of rotation passing through the first and second inlets.

15. The headband of claim 1, wherein the outlet is rectangular.

* * * * *